United States Patent [19]

Friedman

[11] Patent Number: 4,893,221

[45] Date of Patent: Jan. 9, 1990

[54] PORTABLE LIGHT

[76] Inventor: Arthur S. Friedman, Box 625, 2144 Seneca W., Merrick, N.Y. 11566

[21] Appl. No.: 381,985

[22] Filed: Jul. 19, 1989

[51] Int. Cl.[4] ..... F21L 15/14

[52] U.S. Cl. ..... 362/108; 362/197; 362/199; 362/802; 362/375

[58] Field of Search ..... 362/103, 108, 197, 199, 362/287, 375, 802

[56] References Cited

U.S. PATENT DOCUMENTS

| | | | |
|---|---|---|---|
| 1,247,346 | 11/1917 | Stern | 362/197 X |
| 1,360,988 | 11/1930 | Potstada . | |
| 1,403,378 | 1/1922 | Bason . | |
| 1,406,452 | 2/1922 | Evans et al. | 362/197 |
| 1,470,432 | 5/1922 | Evans . | |
| 1,820,960 | 9/1931 | Champagne et al. | 362/197 |
| 1,825,088 | 4/1930 | Powell et al. . | |
| 1,984,398 | 10/1933 | Dame . | |
| 2,320,193 | 1/1942 | Powell et al. . | |
| 3,225,982 | 3/1964 | Melton . | |
| 3,479,499 | 11/1969 | Dahl | 362/199 X |
| 3,731,084 | 5/1973 | Trevorrow . | |
| 4,298,913 | 11/1981 | Lozar . | |
| 4,432,042 | 2/1984 | Zeller . | |
| 4,459,646 | 7/1984 | Drane | 362/199 |
| 4,631,644 | 12/1986 | Dannhauer . | |
| 4,680,681 | 7/1987 | Fisherman et al. . | |
| 4,794,496 | 12/1988 | Lanes et al. . | |

OTHER PUBLICATIONS

Radio Shack Catalog No. 61-2510.

*Primary Examiner*—Allen M. Ostrager

*Attorney, Agent, or Firm*—Dennison, Meserole, Pollack & Scheiner

[57] ABSTRACT

A portable light including a flat battery case with a lamp housing pivotally joined to one edge thereof and projecting therefrom for movement between a closed position generally coplanar with the battery case and an open position pivoted upward therefrom. In the closed position the open face of the lamp housing closes against and is protected by a closure plate rigid with and extending from the battery case. The bulb in the lamp housing is automatically illuminated in response to an open pivoting of the lamp housing relative to the battery case through switch contacts which engage in response to pivotal movement of the lamp housing.

11 Claims, 2 Drawing Sheets

PORTABLE LIGHT

BACKGROUND OF THE INVENTION

Portable lights incorporating a bulb and an appropriate battery or battery pack are well known and take a variety of forms from hand-held cylindrical flashlights to illumination units mounted on the head or suspended from the neck to free the hands of the user.

The known "hands free" lights are frequently bulky assemblies which, while possibly adequate for limited tasks, are not particularly adapted for more universal use under a variety of circumstances outside of the home or workplace.

Basically, the conventional portable light is not adapted for convenience storage, as in pocket or purse, so as to be concealed yet readily available for use in a vehicle, theater, restaurant or the like, wherever insufficient light, for reading in particular, might be encountered.

While extremely small portable lights, such as single battery flashlights, are known, these do not provide either the convenience or capability as required for a reading light which would enable a user to comfortably hold and read a book, newspaper, restaurant menu, or the like. The lack of universal practicality of known portable light limits their use by the public in general, notwithstanding the substantial desirability of every member of the traveling public having an independent source of illumination for convenience and, under some circumstances, even safety.

SUMMARY OF THE INVENTION

The portable light of the present invention, in use, is supported on the chest of a user by a neck-encircling adjustable strap. The profile of the light is thin, with the battery case portion thereof being in the nature of a flat pack accommodating and closely conforming to four transversely aligned AA batteries. The lamp housing in turn extends substantially coplanar from one edge of the battery case to maintain the thin profile of the light whereby the entire assembly can be easily slipped into the pocket or purse of a user so as to be always conveniently available.

The accommodation of four batteries within a flat pack provides, in an easily carried light, substantial illuminating power both in terms of brightness and long life.

The lamp housing, within the thin profile of the portable light, includes a wide reflector which insures maximum illumination over an area sufficient for the reading of a newspaper, large magazine, or the like. This reflector, with mounted bulb, when coplanar with the battery case or casing, has the open face thereof closed by engagement with a plate rigid with the battery case and projecting generally coplanar with the bottom panel thereof whereby the lamp or bulb itself is completely enclosed and protected when not in actual use.

The illumination of the lamp is directly controlled by pivotal opening of the lamp housing whereby, upon movement of the lamp housing a predetermined distance from the closure plate, the lamp is illuminated and remains illuminated through a substantial range of pivotal adjustment, thus avoiding the necessity for a separate manually actuated switch such as might be accidentally tripped, particularly while the light is stored within one's pocket or purse.

Other features and advantages of the invention will become more apparent from the following detailed description of the invention.

DESCRIPTION OF THE PREFERRED EMBODIMENT

Figure 1:
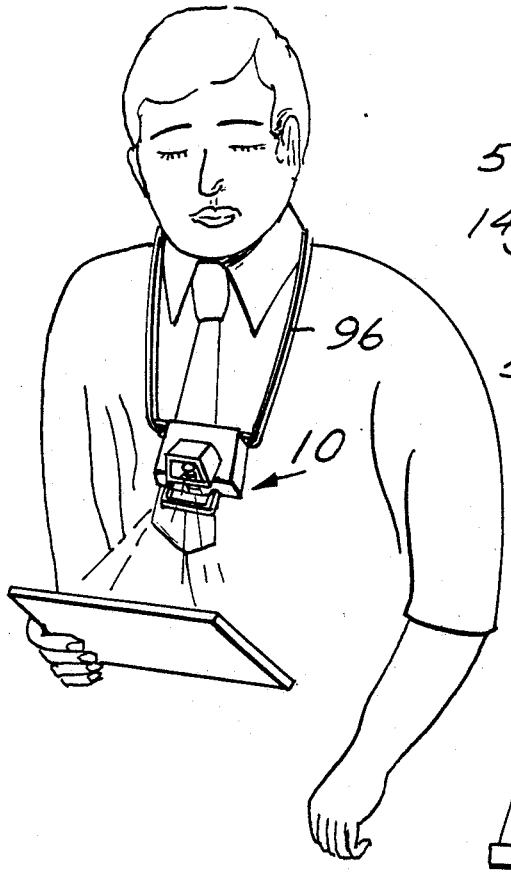
FIG. 1 is an illustration of the portable light in use on a user.

Referring now more specifically to the drawings, the portable light 10 basically comprises a flat rectangular battery case 12 and a generally rectangular lamp housing 14 pivoted thereto.

The battery case 12 includes a planar upper facing panel 16 with integral depending peripheral walls thereabout comprising front and rear walls 18 and 20, and opposed side walls 22, combining to define a downwardly opening battery compartment 24 of a size so as to closely accommodate four transversely aligned AA batteries 26 positioned parallel to each other in two pairs to the opposite sides of a central storage and switch chamber 28 defined by a pair of laterally spaced intermediate walls 30 paralleling and laterally confining the two pairs of batteries 26. The compartment is closed by a removable planar lower backing panel 32.

Figure 5:
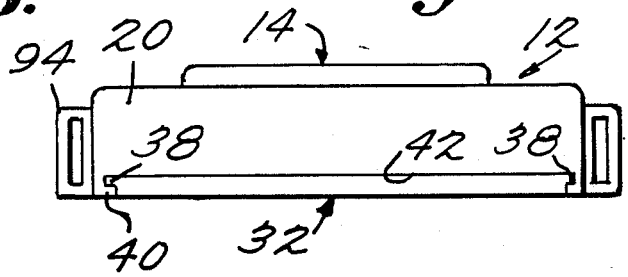
FIG. 5 is a rear elevational view of the portable light.

The backing panel 32 has a forwardly directed latching tongue 34 integral therewith and extending centrally from the forward edge of the backing panel 32 for selective snap-engagement within a complementary slot 36 defined in the front wall 18. The opposed sides of the backing panel 32, noting FIG. 5, include lateral extensions 38 slidably engaged on opposed shoulders 40 on the inner surfaces of the opposed side walls 22 of the battery case 12. The rear wall 20 of the battery case 12 includes a cut-out portion 42 therein complementary in shape to the backing panel 32 for slidable introduction and removable of the backing panel.

The forward portion of the battery case 12 is provided with a mounting recess 44 formed centrally therein and opening through both the upper panel 16 and the front wall 18 for pivotal mounting of the lamp housing 14 as shall be described subsequently. The recess 44 includes parallel, spaced, lateral walls 46, a bottom wall 48 and a rear wall 49.

The lamp housing 14 is positioned centrally along the forward wall 18 of the battery case 12 in forwardly extending relation thereto. The lamp housing 14 is preferably slightly narrower than the transverse width of the battery case 12 and is of a thickness slightly greater than that of the case to accommodate a substantial bulb compartment 50. The bulb compartment 50 is defined by a top panel 52, laterally opposed vertical side panels 54, a rear panel 56, and an outwardly inclined front panel 58, forming the downwardly or forwardly opening bulb compartment 50 with a free peripheral edge 60.

Figure 2:
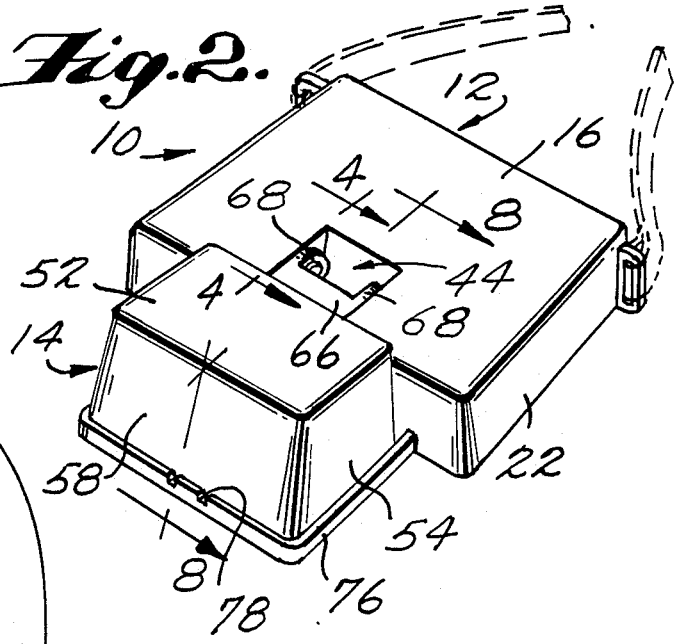
FIG. 2 is a top perspective view of the portable light in its closed position.
Figure 3:
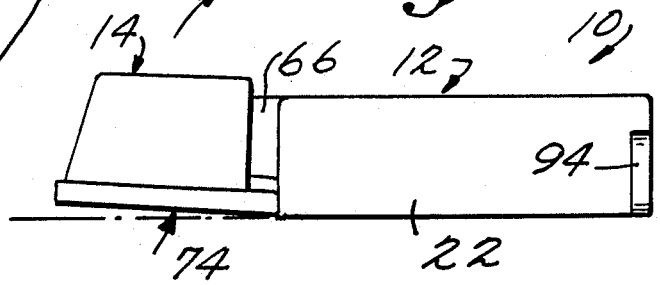
FIG. 3 is a side elevational view of the portable light.
Figure 4:
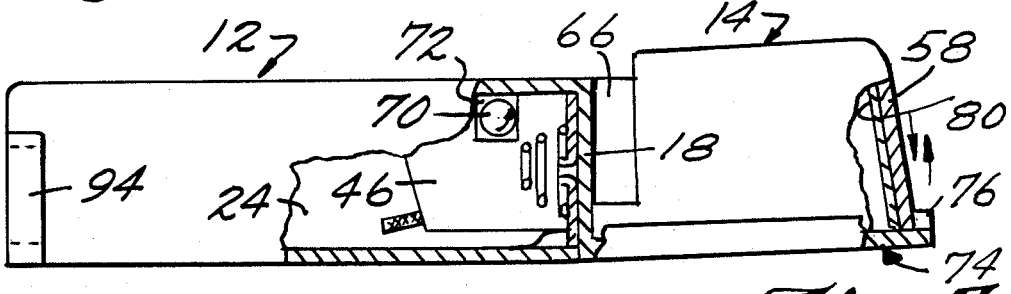
FIG. 4 is an enlarged side elevational view illustrating portions, substantially on line 4—4 of FIG. 2, in section for purposes of illustration.
Figure 6:
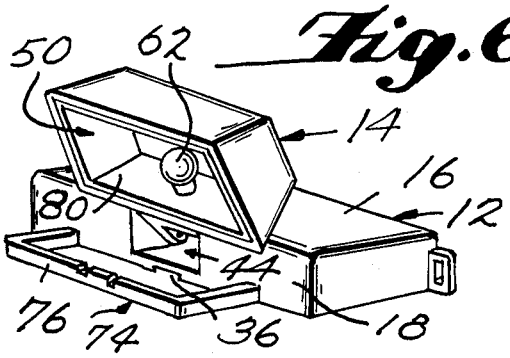
FIG. 6 is a perspective view of the portable light in its opened and illuminating position.

The bulb 62 is screw-mounted, through the rear panel 56, into an appropriate socket 64 mounted within a central rearwardly direction extension 66 on the rear panel 56. The extension 66 is in turn provided with a pair of laterally spaced rearwardly directed mounting ears 68 which are received within the recess 44 immediately inward of the opposed lateral walls 46. Each of the ears 68 is pivotally mounted to the adjoining wall 46 by appropriate pivot means, for example a pivot pin 70 extending laterally from each ear 68 and rotatably received within an appropriate socket 72 within the adjoining wall 46 for pivotal movement of the light housing 14 between a closed forwardly projecting position generally paralleling the battery case 12, as illustrated in FIGS. 2–4 in particular, and an upwardly pivoted open or in-use position as suggested in FIGS. 1 and 6.

In order to enclose the open face of the lamp housing 14 in the closed position thereof, a planar closure plate 74 is provided rigid, for example by integral molding, with the forward wall 18 of the battery case 12 and extending forwardly therefrom generally coplanar with, or at a minor angular inclination from the plane of the lower face of the battery case 12 defined by the backing panel 32. The closure plate 74 is of a size so as to receive the open face of the lamp housing 14 defined by the peripheral edge 60. The plate 74 is provided with an upwardly projecting peripheral lip 76 along the opposed side edges and across the front edge thereof for engagement of the edge portion of the lamp housing immediately inward thereof. An inherent degree of flexibility in this lip 76, particularly across the front edge of the plate 74, enhanced by a pair of central vertical slits 78, allows for a snap-engagement of the housing edge portion within the lip 76 and to the surface of the plate 74 whereby the housing can be locked in its closed and protected position until manually moved therefrom. A close tolerance is provided between the lip, for the full length thereof, and the corresponding edge portion of the lamp housing so as to enhance the engagement therebetween and the retention of the lamp housing in its closed position. As suggested in FIGS. 4 and 8, the portion of the lip 76 along the forward edge of the closure plate 74 can be slightly rearwardly inclined to follow the general inclination of the front panel 58 of the housing to achieve the desired snap-interfit.

The lamp housing 14, when engaged with the closure plate 74, is of a height only slightly greater than that of the flat battery pack 12, thus providing a slim overall configuration easily stored within one's pocket or purse. The lamp housing 14 is transversely elongated and includes an internal white reflector 80 coextensive with the interior surfaces of the housing 14. The width of the housing provides for a substantial divergence of the illumination from the centrally mounted lamp or bulb 62, with the size and configuration of the lamp housing 14 being such as to, upon a proper angling thereof, be sufficient to illuminate a magazine or even a newspaper, or at least a substantial portion thereof.

Figure 9:
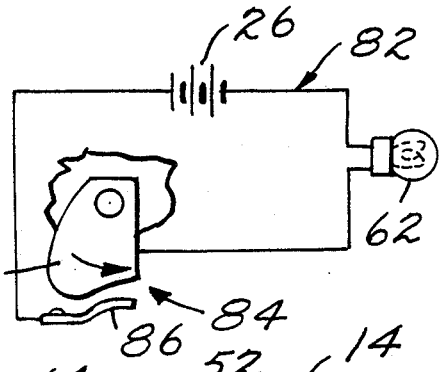
FIG. 9 is a schematic illustration of the lamp-illuminating circuit.
Figure 8:
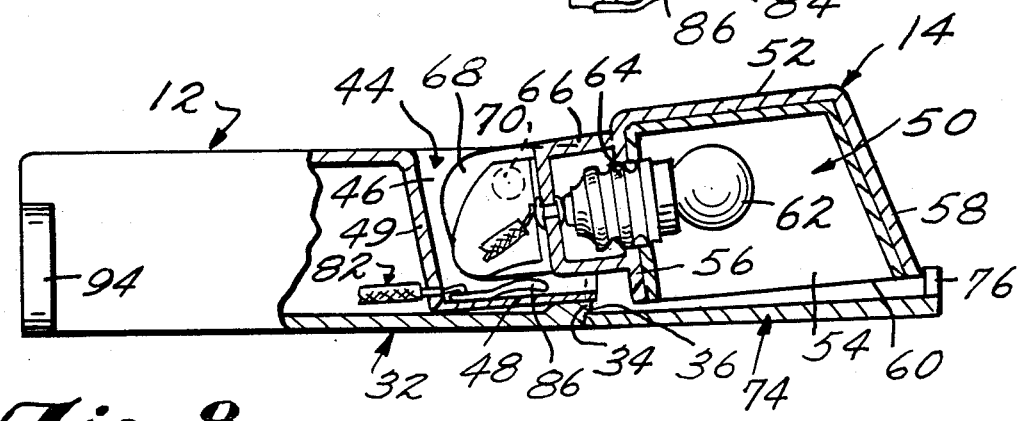
FIG. 8 is a side elevational view with a portion substantially on line 8—8 in FIG. 2, in sections and illustrating the switch means responsive to opening of the lamp housing.

Noting FIGS. 8 and 9, the electrical circuit 82 between the multiple batteries 26 and the bulb 62 includes a switch 84 responsive to the opening and closing of the lamp housing 14 relative to the battery case 12 so as to close the circuit and illuminate the bulb 62 as the lamp housing 14 moves away from the closed position into the open position. As will be appreciated, the open position is in fact an adjustable position ranging over an arc of approximately 90° upward from the closed position.

The switch, in a preferred embodiment, includes a flexible spring-like contact 86 mounted to extend in overlying relation to the bottom wall 48 of the mounting recess 44. A second contact 88, in the nature of an arcuate cam, is affixed adjacent the inner surface of one of the mounting ears 84, extending slightly inward thereof and in rotational alignment with the spring contact 86. The cam contact 88 is so oriented whereby rotation thereof with the lamp housing about the journalled pins 70 brings the outer camming edge of the cam contact 88 into circuit-closing engagement with the spring contact 86. The arc of the cam contact 88 is such so as to maintain engagement with the spring contact 86 throughout substantially the entire pivotal range of the lamp housing 14 relative to the battery case 12. Upon a moving of the lamp housing 14 to its closed position sealing the open face thereof against the closure plate 74, the cam contact 88 pivots away from the spring contact 86 and opens the circuit, thereby extinguishing the bulb 62. As will be recognized, with the lamp housing closed, the bulb is fully concealed and protected.

Figure 7:
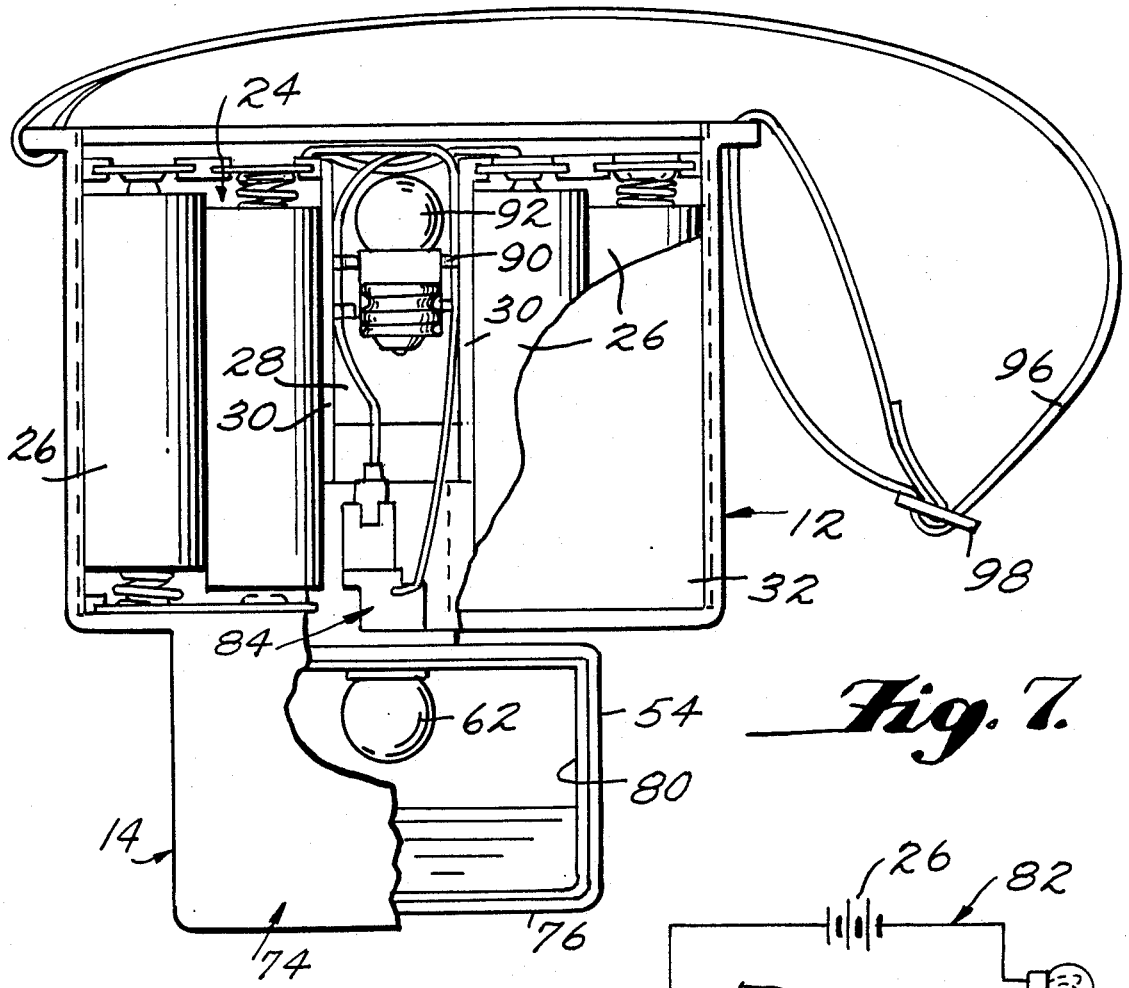
FIG. 7 is a bottom plan view of the portable light with portions broken away for purposes of illustration.

Noting FIG. 7, it will be seen that the batteries 26 are wired in series utilizing pairs of opposed contacts, one of which comprises a battery-biasing spring. It will also be noted in FIG. 7 that the central storage chamber 28 includes a pair of opposed spring clamps 90 for the mounting of a replacement bulb 92 between the two battery chambers.

In order to mount the portable light 10 in its operative position, as suggested in FIG. 1, the battery case 12 includes, coplanar with the rear wall 20 thereof, a pair of opposed outwardly projecting apertured ears 94 which receive opposed ends of a flexible strap 96. The length of the strap 96 is adjustable in a conventional manner utilizing an apertured buckle 98 through which the strap is looped. The strap will be at least 30 inches long so as to, upon mounting about the neck of a user, position the portable light approximately 15 inches below the neck for a convenient illumination of hand-held reading material or the like.

While the plate 74 receiving and closing the open face of the lamp housing 14 has heretofore been described as a protective means for the lamp housing, this plate also provides a significant additional advantage. More specifically, in projecting forwardly or downwardly from the battery case, beyond the point of pivotal mounting of the lamp housing 14 and the upwardly pivoted lamp housing in the open position thereof, this plate also stabilizes the portable light 10 against any tendency to forwardly tip and thus affect the stability of the light. In other words, the portable light includes a planar base support both above and below the lamp itself. As desired in order to more closely conform to the lower chest or upper stomach area of the user, the closure plate 74 can be slightly upwardly inclined relative to the plane of the backing panel 32. As will be appreciated from the drawings, and in particular FIG. 3, this inclination is minor, so as to encourage a flat engagement of the light against the body while at the same time preventing the above-referred to tipping or tilting.

To maintain the lamp housing 14 in an adjusted open position, the ears 68 of the lamp housing 14 which pivotally mount the lamp housing can frictionally engage the opposed walls 46 of the recess 44. This stabilization of the adjusted lamp housing will also be enhanced by the engagement of the switch contacts 86 and 88. Additional or different means can also be provided as desired to releasably retain the lamp housing in any adjusted open position during use.

It is contemplated that the overall dimensions of the portable light be approximately $\frac{3}{4}'' \times 3\frac{1}{4}'' \times 3\frac{3}{4}''$ with the lightweight flat compact nature thereof enabling its use under substantially any condition wherein additional light is required, for example on planes or trains, in bed, camping, theaters, restaurants, etc.

The light is "hands free" in use with the adjustable neck strap providing for a raising or lowering of the portable light to suit the individual. Similarly, the lamp housing, with reflector, can be positioned and adjusted as desired.

The case in particularly adapted to accommodate four AA alkaline batteries in parallel lateral coplanar relation to each other to provide a powerful light in an extremely compact body. The reflector itself, being substantially wider than the bulb, provides a wide beam of light for reading. Further, the reflector, extending a substantial distance to each side of the bulb, facilitates bulb replacement in that the user's fingers can easily be introduced into the wide, open face of the reflector for bulb extraction and replacement. Notwithstanding the size of the reflector, the configuration thereof is such as to shield the light in a manner so as to not disturb or interfere with others in the vicinity thereof.

The automatic light switch which is activated in response to pivotal movement of the lamp housing is significant in that, in order to use the portable light, one need merely pivotally adjust the lamp housing, and thus not be concerned with locating an manipulation additional switch means.

Other advantages of the portable light of the invention will be recognized.

What is claimed is:

1. A portable light comprising a battery case, a lamp housing, means mounting said lamp housing to said battery case for pivotal movement of the lamp housing between a closed position and an open position, means for forming an electrical circuit between said battery case and said lamp housing, said lamp housing defining a bulb compartment with an open face, said lamp housing projecting laterally from said battery case, a closure plate rigid with said battery case and projecting therefrom, said lamp housing, in the closed position, having the open face thereof engaged with and closed by said closure plate, and switch means for selectively opening and closing said circuit in response to pivotal movement of said lamp housing for closing said circuit in the open position of the lamp housing, and opening said circuit in the closed position of the lamp housing.

2. The portable light of claim 1 wherein said battery case includes an upper face panel, peripheral walls rigid with and depending from said face panel and defining a battery compartment, said peripheral walls including a forward wall, said closure plate extending forwardly from said forward wall in spaced relation to and below said upper face panel, said lamp housing extending from said forward wall, said lamp housing, in the closed position thereof, extending generally parallel to said battery case, said lamp housing, in the open position thereof, extending above and at an angle to said upper face panel.

3. The portable light of claim 2 including a planar lower backing panel on said battery case generally paralleling said upper face panel, said closure plate being generally coplanar with said backing panel.

4. The portable light of claim 3 wherein the peripheral walls of the battery case include a rear wall generally opposed and parallel to said forward wall, and an adjustable neck strap secured to the rear wall at a pair of spaced points and extending in a loop therefrom, whereby said portable light can depend from the neck of a user with the lamp housing downwardly directed relative to the neck.

5. The portable light of claim 4 wherein said backing panel is selectively removable to allow access to said battery compartment.

6. The portable light of claim 5 wherein said switch means comprises a pair of contacts in said circuit spaced from each other in the closed position of said lamp housing, and means for engaging said contacts upon movement of said lamp housing to the open position, said open position comprising a range of pivotal movement of said lamp housing away from engagement with said closure plate.

7. A portable light comprising a flat battery case including opposed generally planar upper face and lower pack panels with peripheral walls therebetween defining a battery compartment, a lamp housing extending from a peripheral wall of said battery case, means mounting said lamp housing on said battery case for pivotal movement between a closed position projecting from said battery case in substantial parallel alignment with said battery case and an open position projecting from said battery case, at an outwardly inclined angle to said face panel, and wherein said lamp housing includes a bulb compartment with an open face, and means closing said open face in the closed position of said lamp housing.

8. The portable light of claim 7 wherein said means closing said open face comprises a plate extending from the battery case below and substantially parallel to said lamp housing in the closed position thereof, said open face of said bulb compartment being directed toward and closed by said plate in the closed position of said lamp housing.

9. The portable light of claim 8 including means for releasably retaining said lamp housing in said closed position.

10. The portable lamp of claim 9 wherein said plate extends from said battery case at an upwardly inclined acute angle relative to the plane of the back panel.

11. The portable light of claim 9 including an electrical circuit between said battery case and said lamp housing, and switch means for opening said circuit in response to movement of said lamp housing to said closed position and closing said circuit in response to movement of said housing to said open position.

* * * * *

UNITED STATES PATENT AND TRADEMARK OFFICE

CERTIFICATE OF CORRECTION

PATENT NO. : 4,893,221

DATED : January 9, 1990

INVENTOR(S) : Arthur S. Friedman

It is certified that error appears in the above-identified patent and that said Letters Patent is hereby corrected as shown below:

Column 6, line 31, change "pack" to -- back --

Signed and Sealed this

Eighteenth Day of December, 1990

*Attest:*

HARRY F. MANBECK, JR.

*Attesting Officer*

*Commissioner of Patents and Trademarks*